US011802372B2

(12) United States Patent
Reiter

(10) Patent No.: US 11,802,372 B2
(45) Date of Patent: Oct. 31, 2023

(54) ROPE MADE OF TEXTILE FIBER MATERIAL, COMPRISING A TWINE OF EXCESS LENGTH

(71) Applicant: Teufelberger Fiber Rope GmbH, Wels (AT)

(72) Inventor: Arno Reiter, Spital am Pyhrn (AT)

(73) Assignee: TEUFELBERGER FIBER ROPE GMBH, Wels (AT)

( * ) Notice: Subject to any disclaimer, the term of this patent is extended or adjusted under 35 U.S.C. 154(b) by 13 days.

(21) Appl. No.: 17/468,959

(22) Filed: Sep. 8, 2021

(65) Prior Publication Data

US 2022/0074136 A1 Mar. 10, 2022

(30) Foreign Application Priority Data

Sep. 10, 2020 (EP) ..... 20195558

(51) Int. Cl.
*D07B 1/02* (2006.01)
*D07B 1/16* (2006.01)

(52) U.S. Cl.
CPC ..... *D07B 1/025* (2013.01); *D07B 1/162* (2013.01); *D07B 2201/102* (2013.01); *D07B 2201/1096* (2013.01); *D07B 2501/2069* (2013.01)

(58) Field of Classification Search
CPC ..... D07B 1/02; D07B 1/025; D07B 1/162; D07B 2201/102; D07B 2201/1096; D07B 2501/2069; D02G 1/18; D02G 3/28; A63B 29/028
See application file for complete search history.

(56) References Cited

U.S. PATENT DOCUMENTS 2,656,585 A * 10/1953 Jackson ..... D02G 1/18 8/114.5
3,030,851 A * 4/1962 Meyer ..... A63B 29/028 87/9
4,155,394 A * 5/1979 Shepherd ..... D02G 3/48 57/238

(Continued)

FOREIGN PATENT DOCUMENTS

DE 4035814 5/1992
DE 102011017273 10/2012

(Continued)

OTHER PUBLICATIONS

International Search Report issued in EP20195558 dated Feb. 3, 2021.

*Primary Examiner* — Shaun R Hurley
(74) *Attorney, Agent, or Firm* — Workman Nydegger

(57) ABSTRACT

The invention relates to a rope made of textile fiber material, comprising a rope core and a sheath surrounding the rope core, wherein the sheath, an intermediate sheath located between the sheath and the rope core and/or a reinforcement located between the sheath and the rope core comprise(s) a twine of excess length, the twine of excess length being formed in that it comprises at least a first yarn and a second yarn which are twisted together, the first yarn having a greater length than the second yarn, measured in an untwisted state of a unit length of the twine. In a further aspect, the invention relates to a method of manufacturing a twine of excess length for the above-mentioned rope.

20 Claims, 3 Drawing Sheets

(56) References Cited

U.S. PATENT DOCUMENTS

| | | | | | |
|---|---|---|---|---|---|
| 4,240,486 | A * | 12/1980 | Schmit | B60C 9/005 | 57/902 |
| 4,343,343 | A * | 8/1982 | Reuter | D07B 1/062 | 428/377 |
| 4,375,779 | A | 3/1983 | Fischer | | |
| 4,534,262 | A * | 8/1985 | Swenson | D07B 1/24 | 84/2 |
| 4,640,178 | A * | 2/1987 | Kurzbock | D07B 1/02 | 87/8 |
| 4,877,073 | A * | 10/1989 | Thise | D02G 3/48 | 57/902 |
| 6,050,077 | A | 4/2000 | Muller | | |
| 6,216,431 | B1 * | 4/2001 | Andrews | D02G 3/38 | 428/394 |
| 6,601,378 | B1 * | 8/2003 | Fritsch | D02G 3/28 | 57/244 |
| 7,047,860 | B2 * | 5/2006 | Faborsky | D07B 1/02 | 87/9 |
| 7,051,507 | B2 * | 5/2006 | Fritsch | B60C 9/005 | 57/314 |
| 7,360,477 | B2 * | 4/2008 | Hess | D07B 1/148 | 87/13 |
| 7,703,372 | B1 * | 4/2010 | Shakespeare | D07B 1/04 | 87/13 |
| 8,136,438 | B2 * | 3/2012 | Shakespeare | D07B 1/04 | 87/6 |
| 9,175,425 | B2 * | 11/2015 | Love | H01B 13/0003 | |
| 9,617,663 | B2 * | 4/2017 | Jeon | D02G 3/40 | |
| 10,968,546 | B2 * | 4/2021 | Michaels | D02G 3/26 | |
| 2013/0042593 | A1 | 2/2013 | Rampana et al. | | |
| 2014/0237983 | A1 * | 8/2014 | Love | D02G 3/04 | 57/58.7 |
| 2014/0238524 | A1 * | 8/2014 | Love | F16L 11/02 | 138/118 |
| 2015/0292124 | A1 * | 10/2015 | Lee | D02G 3/48 | 57/296 |
| 2020/0040524 | A1 * | 2/2020 | Michaels | D02G 3/26 | |

FOREIGN PATENT DOCUMENTS

| | | |
|---|---|---|
| EP | 0150702 | 8/1985 |
| FR | 2951743 | 4/2011 |
| GB | 1012828 | 12/1965 |
| JP | S53134953 | 11/1978 |
| JP | H07243138 | 9/1995 |
| JP | H0866922 | 3/1996 |
| JP | 3185821 | 7/2001 |

* cited by examiner

ROPE MADE OF TEXTILE FIBER MATERIAL, COMPRISING A TWINE OF EXCESS LENGTH

CROSS REFERENCE TO RELATED APPLICATION

This application claims the benefit of European Patent Application No. 20195558.0, filed Sep. 10, 2020, which is incorporated by reference in its entirety.

BACKGROUND OF THE INVENTION

The invention relates to a rope made of textile fiber material, comprising a rope core and a sheath surrounding the rope core.

Fiber ropes from various fields of application are known from the prior art. For example, fiber ropes are used as climbing ropes, accessory cords or lanyards for securing individuals. Ropes can also be used in the mechanical field, for example as winch ropes. The ropes described herein are all designed in such a way that they have a diameter ranging from 5 mm to 60 mm.

Depending on the desired application, the fiber ropes should have a predetermined cut resistance. For example, dynamic mountaineering ropes are used to secure the climber against falling and to slow down a fall. Mountaineering ropes are used, among other things, in alpine terrain, where they are often exposed to rock edges—both under static loads and under dynamic fall loads. It is apparent that such ropes should have a high cut resistance in order to avoid accidents.

One solution for increasing the service life of mountaineering ropes is disclosed in document FR 2 951 743, which shows a metallic sleeve which is guided around part of the rope. If the rope is to be laid around a sharp edge, the sleeve is guided over the rope in this area so that the sharp edge will act only on the sleeve and not on the textile rope.

EP 0 150 702 A2 proposes the manufacture of a mountaineering rope which is supposed to have a longer service life as it is diverted around sharp edges. For this purpose, monofilaments or, respectively, wires are wound, braided or spun around the rope core or the entire rope.

Furthermore, it is known from the prior art that high-strength fibers, in particular aramid, generally have a higher cut resistance than conventional fibers such as polyamide. From U.S. Pat. No. 6,050,077 it is known, for example, to produce a safety mountaineering rope which comprises a sheath composed of a mixture of high-strength and non-high-strength fibers, as a result of which the rope performs better in the sharp edge test.

However, it has been found that the use of high-strength fibers also involves disadvantages. In particular, high-strength fibers exhibit very little elongation so that they are ill-suited for slowing down a fall, i.e., absorbing energy by elongation.

Another disadvantage of fibers in general is that the cut resistance of the fibers decreases when the fibers are under tension. The highest cut resistance is thus achieved in the tension-free state. In the aforementioned applications, however, the ropes are usually under tension at the cut, for example when the above-mentioned climber puts strain on the mountaineering rope, chafing it across a rock edge.

It is therefore the object of the invention to overcome the disadvantages of the prior art and to provide a rope made of textile fiber material which has an increased cut resistance even when loaded under tension.

SUMMARY OF THE INVENTION

This object is achieved by a rope made of textile fiber material, comprising a rope core and a sheath surrounding the rope core, wherein the sheath, an intermediate sheath located between the sheath and the rope core and/or a reinforcement located between the sheath and the rope core comprise(s) a twine of excess length, the twine of excess length being formed in that it comprises at least a first yarn and a second yarn which are twisted together, the first yarn having a greater length than the second yarn, measured in an untwisted state of a unit length of the twine. The twine is generally a twisted yarn, i.e. a twisted yarn comprising at least the first yarn and the second yarn which are twisted together.

In other words, the invention pertains to a rope made of textile fiber material, comprising:

- a rope core; and
- a sheath surrounding the rope core;
- wherein the rope comprises a twine of excess length, the twine of excess length being formed so that it comprises at least a first yarn and a second yarn which are twisted together, the first yarn having a greater length than the second yarn, measured in an untwisted state of a unit length of the twine of excess length,
- wherein the twine of excess length is present in at least one of:
  - the sheath,
  - an optional intermediate sheath located between the sheath and the rope core,
  - an optional reinforcement located between the sheath and the rope core.

In one case, the rope only comprises the rope core and the sheath, and the twine of excess length is present in the sheath. In this case, the invention pertains to a rope made of textile fiber material, comprising:

- a rope core; and
- a sheath surrounding the rope core;
- wherein the sheath comprises a twine of excess length,
- the twine of excess length being formed so that it comprises at least a first yarn and a second yarn which are twisted together, the first yarn having a greater length than the second yarn, measured in an untwisted state of a unit length of the twine of excess length.

This rope may optionally—but does not have to—comprise at least one of the intermediate sheath and the reinforcement, wherein another twine of excess length can also be present in the intermediate sheath and/or the reinforcement.

In another case, the sheath does not necessarily comprise a twine of excess length. For example, the rope comprises at least one of the intermediate sheath and the reinforcement, wherein the twine of excess length is present in the intermediate sheath and/or the reinforcement. In other words, the invention also pertains to a rope made of textile fiber material, comprising:

- a rope core;
- a sheath surrounding the rope core; and
- at least one of an intermediate sheath located between the sheath and the rope core or a reinforcement located between the sheath and the rope core,
- wherein at least one of the sheath, the intermediate sheath located between the sheath and the rope core, or the reinforcement located between the sheath and the rope core comprises a twine of excess length, the twine of excess length being formed so that it comprises at least a first yarn and a second yarn which are twisted together, the first yarn having a greater length than the second yarn, measured in an untwisted state of a unit length of the twine of excess length.

The twine of excess length in the rope according to the invention allows some fibers to be in a tension-free state even when the rope is tensioned. If the rope and the twine enclosed in it are tensioned to an excess length, only the second yarn is tensioned due to its shorter length and the first yarn continues to be in a tension-free state due to its greater length. Since fibers, as already mentioned in the introduction, have a lower cut resistance under tension, the first yarn having a greater length enables an increased cut resistance when the rope is in the tensioned state. Therefore the "twine of excess length" comprises the excess length within the twine itself and could also be called "twine with excess length" or simply "twine", as the excess length within the twine is defined by the feature "wherein the twine is formed so that it comprises at least a first yarn and a second yarn which are twisted together, the first yarn having a greater length than the second yarn, measured in an untwisted state of a unit length of the twine".

In contrast to the prior art, a fiber rope is thus created which has an increased cut resistance and can be designed so as to be free of metal at least on the surface, whereby the risk of injury in the event of wire breaks is avoided. Furthermore, metal wires with electrical conductivity could be present in the interior of the rope, whereby they can be used, for example, as conductors or sensors. Due to the initially explained properties, the rope according to the invention is particularly suitable for use as a mountaineering rope, as a rope for connecting means, for loops or also as a winch rope.

In a particularly preferred embodiment, the first yarn comprises high-strength fibers, preferably p-aramid fibers, m-aramid fibers, UHMWPE fibers or PBO fibers. This allows the twine to have a particularly high cut resistance in the tensioned state, since high-strength fibers have a better cut resistance than conventional fibers. In other embodiments, however, it is also possible to produce the first yarn from non-high-strength fibers in order to achieve at least a certain increase in the cut resistance.

In a further embodiment, the second yarn comprises non-high-strength fibers, preferably PA fibers, PES fibers or PP fibers. Since non-high-strength fibers usually have a higher elongation than high-strength fibers, it is preferred for some applications to produce the force-absorbing part of the twine, i.e., the second yarn, from non-high-strength fibers. This is particularly preferred for mountaineering ropes so that the second yarn is able to better absorb energy through elongation.

It is preferred if the first yarn is at least 5%, preferably at least 8%, particularly preferably at least 12%, longer than the second yarn, measured in the untwisted state of the unit length of the twine. As a result, the first yarn is long enough for being in a tension-free state in the tensioned state of the rope or the twine of excess length or the second yarn, respectively, even if the rope or the twine of excess length or the first yarn, respectively, is stretched.

Furthermore, the twine is preferably designed in such a way that the weight proportion of the second yarn in the twine of excess length is 30% to 90%, preferably 40% to 75%. This results in a good ratio between the first yarn and the second yarn, whereby, on the one hand, the second yarn is able to absorb enough energy under tension and, on the other hand, the first yarn is present to a sufficient extent to fulfill its function of increasing the cut resistance.

Moreover, it is advantageous if the weight proportion of the twine of excess length in the sheath, in the intermediate sheath and/or in the reinforcement, in each case, accounts for 50% to 100% of the sheath, the intermediate sheath or the reinforcement, respectively. It is understood that the choice of the proportion of twine in the rope largely depends on the desired application so that less twine of excess length can also be used for other applications.

The rope core of the rope according to the invention can also be constructed differently depending on the application. The rope core is preferably constructed from one or several twisted or braided cores. Especially if the rope is designed for applications as a mountaineering rope, it is common to provide several cores in the rope core. However, when it is used as a winch rope, the rope according to the invention generally comprises only one core as a rope core.

If the rope core is supposed to have a high degree of elongation, for example, in order to absorb energy by elongation in the event of a fall, the rope core may comprise non-high-strength fibers, preferably PA fibers, PES fibers or PP fibers. In this embodiment, the rope can be designed, for example, as a climbing rope according to the EN892 standard. In these embodiments, the use of the rope as a climbing rope is therefore particularly suitable.

However, if the elongation of the rope core only plays a minor role or should be low for the application, the rope core may also comprise high-strength fibers, preferably aramid fibers, UHMWPE fibers, PBO fibers or Vectran fibers. This embodiment is preferred in particular for usage as a winch rope.

Regardless of the application, it is preferred for the rope according to the invention if the diameter of the rope is 5 mm to 60 mm, preferably 5 mm to 13 mm.

The twine of excess length for the rope according to the invention can be manufactured in various embodiment variants. Particularly preferably, however, the following two alternative manufacturing methods are used.

The first preferred method of manufacturing the twine of excess length comprises the steps of:

providing the first yarn and the second yarn;

plying or, respectively, twisting the first yarn with the second yarn;

wherein the first yarn and the second yarn are twisted together with essentially the same tension and the same length and the twine is subjected to a shrinking process after twisting.

In this first preferred manufacturing method, two yarns are used which are manufactured in such a way that they shrink to different degrees. For example, fibers of different materials can be used for this purpose.

The shrinking process is preferably performed in an autoclave. Before the twine is introduced into the autoclave, it is preferably prepared in order to enable defined shrinkage. Particularly preferably, the preparation can be effected by knitting, with the knitted fabric being unravelled after the shrinking process. The way of preparing the twines, e.g., by knitting, the choice of temperature and/or pressure in the autoclave can be done by a person skilled in the art.

The second preferred method of manufacturing the twine of excess length comprises the steps of:

providing the first yarn and the second yarn;

plying or, respectively, twisting the first yarn with the second yarn;

wherein the first yarn and the second yarn are twisted together with different tensions and the twine is relaxed after twisting.

In the second preferred manufacturing method, two yarns may also be used which are produced in the same way and the fibers of which are made of the same materials.

The manufacture of the rope according to the invention usually takes place in one step, wherein the rope core or, respectively, the cores is/are introduced into a braiding machine, wherein, among other things, the twine of excess length is braided around said core(s), whereby the sheath and, if applicable, the intermediate sheath and/or the reinforcement is/are created.

BRIEF DESCRIPTION OF THE DRAWINGS

Advantageous and non-limiting embodiments of the invention are explained in further detail below with reference to the drawings.

DETAILED DESCRIPTION OF THE DRAWINGS

Figure 1:
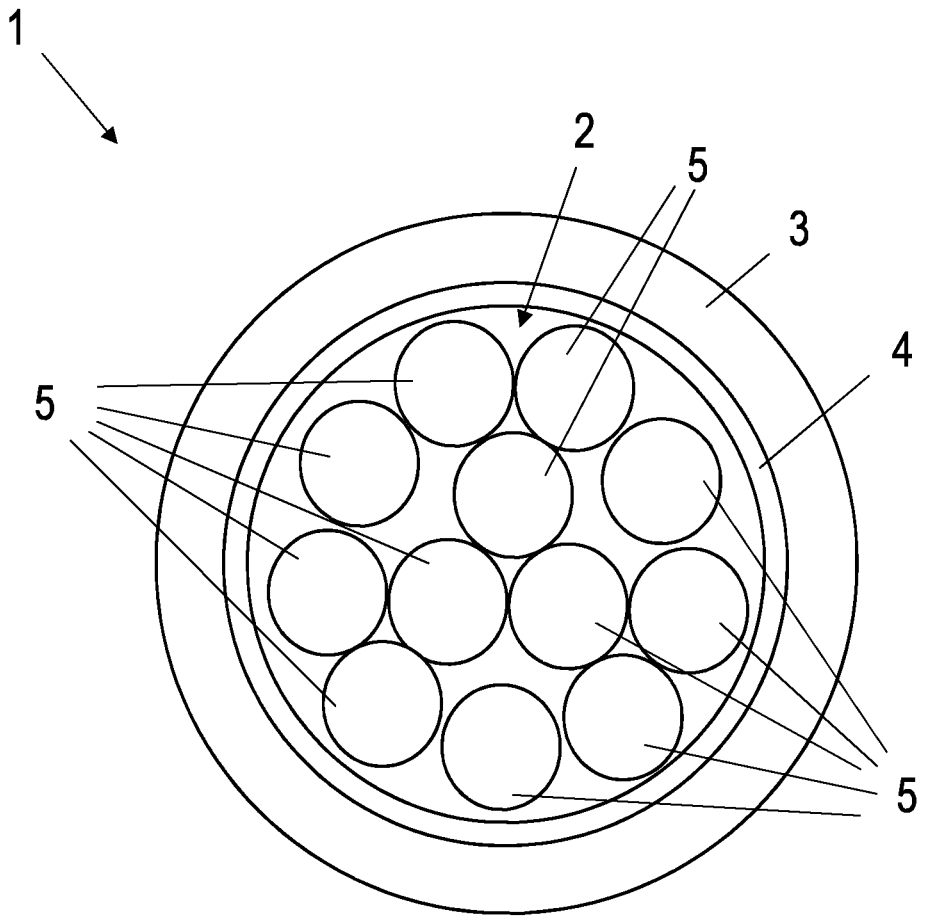
FIG. 1 shows the cross-section of the rope according to the invention.

FIG. 1 shows the cross-section of a rope 1. The rope 1 comprises a rope core 2 and a sheath 3 surrounding the rope core 2. The rope 1 is made of a textile fiber material, i.e., both the rope core 2 and the sheath 3 are made of a textile fiber material. The rope 1 is preferably designed so as to be free of metal, apart from optional connecting elements or clamps that are attached to the ends of the rope 1 or at another point on the rope 1, or functional, electrically conductive wires that are guided within the rope 1 and serve, for example, as conductors, data lines or sensors.

Optionally, the rope 1 may have an intermediate sheath 4 provided between the rope core 2 and the sheath 3. Depending on the embodiment, this intermediate sheath 4 may also be made of textile fiber material and designed so as to be free of metal. As an alternative or in addition to the intermediate sheath 4, a textile, preferably metal-free, reinforcement (not illustrated) may also be used, which herein is understood to be a non-covering intermediate sheath.

As can be seen in FIG. 1, the rope core 2 comprises twelve cores 5. In general, however, the rope core may also have only one core 5 or more than one core 5. The cores 5 are, for example, twisted or braided, but might also be produced in another way.

The rope 1 described herein can be used for various intended purposes, for example as a mountaineering rope, as a rope for connecting means, for loops or as a winch rope. If it is used as a mountaineering rope, the rope 1 is employed, for example, by a climber as a fall protection or is also used as a static accessory cord for makeshift rescue techniques. If it is used as a rope for connecting means, a tree maintenance professional, for example, can employ the rope 1 as a connecting means/lanyard, with the rope 1 looped around the tree and hooked into a harness of the tree maintenance professional so that the tree maintenance professional is able to support themselves in any vertical position on the tree. If intended to be used as a rope for loops, the rope 1 is employed as an auxiliary rope for climbing. If intended to be used as a winch rope, said rope is wound onto a winch and, in contrast to the aforementioned uses, is therefore employed in a mechanical operation and not for protecting people from falling.

In all above-mentioned applications, the rope 1 can have a diameter ranging from 5 mm to 60 mm, preferably from 5 mm to 13 mm.

Especially when the rope 1 is used to prevent falls, the rope core 2 should have advantageous dynamic properties. In such embodiments, the rope core comprises non-high-strength fibers, preferably polyamide (PA) fibers. In other applications, the non-high-strength fibers may also be polyester (PES) fibers or polypropylene (PP) fibers.

In other embodiments, for example when the rope 1 is employed as a winch rope, the rope core 2 can, however, also comprise high-strength fibers. For the purposes of the present invention, "high-strength" is understood to mean fibers with a tensile strength of at least 14 cN/dtex, preferably a tensile strength greater than 24 cN/dtex, particularly preferably greater than 30 cN/dtex. For example, UHMWPE fibers (including Dyneema®), aramid fibers, LCP fibers (including Vectran) or PBO fibers are known as high-strength fiber types with appropriate tensile strengths.

Depending on the embodiment, the rope core 2 or the cores 5 may also comprise a mixture of high-strength fibers and non-high-strength fibers.

In order to increase the cut resistance of the rope 1, said sheath 3, the intermediate sheath 4 and/or the reinforcement comprise(s) the twine 6 of excess length Δ, which will be explained below with reference to FIGS. 2 and 3. The sheath 3, the intermediate sheath 4 and/or the reinforcement can be manufactured completely or partially from several twines 6 of excess length Δ. The sheath 3 and the intermediate sheath 4 are usually braids so that several twines 6 of excess length Δ can be braided together, optionally with other twines being added. Usually, however, the weight proportion of the twine 6 of excess length Δ in the sheath 3, in the intermediate sheath 4 and/or in the reinforcement, in each case, accounts for 50% to 100%.

Figure 2:
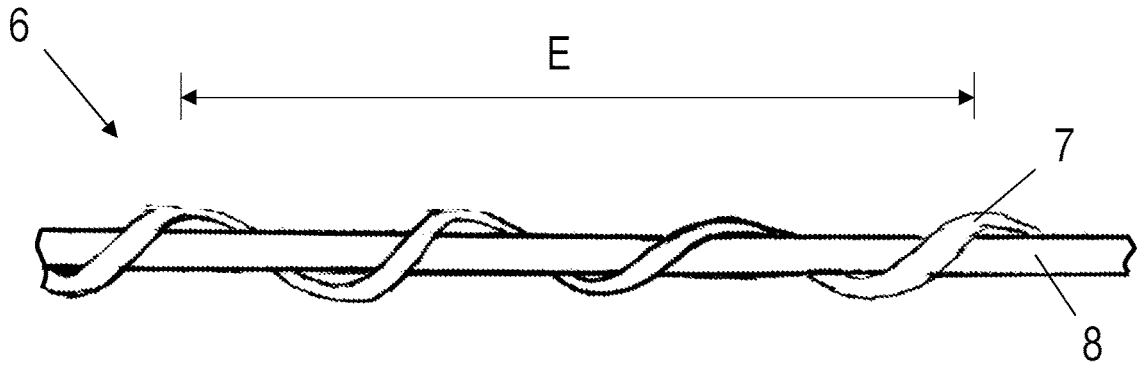
FIG. 2 shows a twine of excess length incorporated in the rope of FIG. 1.

In FIG. 2, the twine 6 of excess length Δ is illustrated, which can be produced in an indefinite length and wound onto at least one bobbin prior to the production of the sheath 3, the intermediate sheath 4 or the reinforcement. In addition, an arbitrarily chosen unit length E of the twine 6 of excess length Δ is depicted in FIG. 2. The numeric quantity of the unit length E can be chosen as desired, for example 1 m. However, the invention is completely independent of the actually chosen length, as will be explained below, and serves only for determining the excess length Δ of the yarn 7 in the twine 6 of excess length Δ.

As is known to a person skilled in the art, twines are produced by twisting several yarns. The twine 6 of excess length Δ as described herein comprises a first yarn 7 and a second yarn 8 which are twisted together. The twisted state of the twine 6 of excess length Δ is illustrated in FIG. 2.

Figure 3:
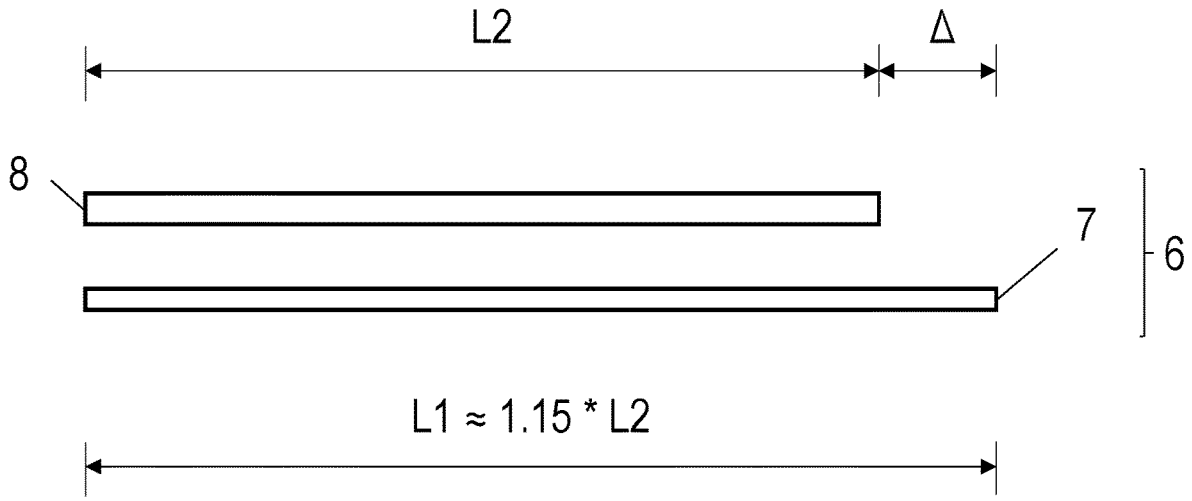
FIG. 3 shows the twine of FIG. 2 in the untwisted state.

FIG. 3 shows the section of the unit length E of the twine 6 of excess length Δ in an untwisted state. It can be seen that the first yarn 7 has a greater length than the second yarn 8. In a practical example, E=1 m was chosen for the unit length. However, as can already be seen in FIG. 2, the first yarn 7 is twisted with the second yarn 8 so that, in parts, small loops of the first yarn 7 form around the second yarn 8.

As can be seen in FIG. 3, the actual length of the first yarn 7 in the untwisted state is greater than the length of the second yarn 8 or the unit length E, respectively. In the above example, in which the unit length E=1 m was chosen, a length L1=1.15 m resulted for the first yarn 7 and a length L2=1 m resulted for the second yarn 8 in the untwisted state of the twine 6 of excess length Δ. In this example, the first yarn 7 is thus 15% longer than the second yarn 8 in the untwisted state of the twine 6 of excess length Δ, the percentage P being calculated by way of P=100*(L1−L2)/L2.

It is evident from the above example that the choice of the unit length E is arbitrary and is used only for determining the relative length of the first yarn 6 in relation to the second yarn. If the unit length E=2 m was chosen, the length L1 of the first yarn 7 in the untwisted state of the twine 6 of excess length Δ would be 2.3 m and the length L2 of the second yarn 8 would be 2 m so that the first yarn 7 would again be 15% longer than the second yarn 8.

In general, the first yarn 7 is at least 5%, preferably at least 8%, particularly preferably at least 12%, longer than the second yarn 8, measured in the untwisted state of the unit length E of the twine 6. As described above, the percentage P is, in each case, indicated with respect to the length L2 of the second yarn 8, i.e., P=100*(L1−L2)/L2. As a result of those length ratios, it is achieved that the first yarn 7 is not yet extended even when the second yarn 8 is stretched. An upper limit to the length by which the first yarn 7 is longer than the second yarn 8 can be, for example, 30%, this upper limit usually only being limited by the manufacturing method.

At this point, it should be noted that the measurement of the length of the first yarn 7 and the second yarn 8 in the untwisted state of the unit length E can occur either in the tension-free state or under a certain pretension, e.g., 0.5+/−0.1 cN/tex. The pretensioning of the yarns may be necessary in order to achieve a correct, comparable measuring result. Standards for measuring the length of yarns are known from the prior art, such as, e.g., DIN 53830-3, which, among other things, specifies a pretension of 0.5+/−0.1 cN/tex for measuring the length of yarns, and may also be used for determining the lengths of the yarns of the rope 1 described herein.

Usually, the first yarn 7 comprises high-strength fibers and the second yarn 8 comprises non-high-strength fibers, with the definition of high-strength being given, as above, with regard to the rope core 2. For example, the high-strength fibers of the first yarn 7 may be p-aramid fibers (para-aramid fibers), m-aramid fibers (meta-aramid fibers), LCP fibers, UHMWPE fibers or PBO fibers. Fibers sold under the names Kevlar, Twaron and Technora are particularly suitable. For the non-high-strength fibers of the second yarn 8, PA fibers, PES fibers or PP fibers may be chosen, for example.

Depending on the embodiment, yarns 7, 8 of different materials can thus be chosen for the twine 6 of excess length Δ. In other embodiments, however, yarns made from the same materials may also be chosen, although there may be restrictions due to the manufacturing methods as described below.

Usually, the ratio of the first yarn 7 to the second yarn 8 is chosen such that the weight proportion of the first yarn 7 of excess length Δ accounts for 30% to 90%, preferably 40% to 75%, in the twine.

However, the structure of the twine 6 is not restricted to the twisting of only two yarns, but more than two yarns might also be twisted together. In the untwisted state of the twine 6 of excess length Δ, all the yarns might then have different lengths. Also, in other embodiment variants, only one yarn could be longer than the other yarns of the same length, or only one yarn could be shorter than the other yarns of the same length. Again, for example, two yarns of the same length could be longer than two other yarns of the same length. It is apparent that there are no limits to the structure of the twine 6 of excess length Δ as long as at least one yarn has a greater length than another yarn, measured in an untwisted state of a unit length E of the twine 6. In those embodiments, it is particularly preferred if the longest yarn is at least 5%, preferably at least 8%, particularly preferably at least 12%, longer than the shortest yarn, measured in the untwisted state of the unit length E of the twine 6.

The twine 6 of excess length Δ can be produced in a wide variety of ways and is not limited to a specific manufacturing method. In particular, however, manufacturing methods performed by means of a shrinking process or under different tensions are appropriate and are described below.

In the manufacturing method using a shrinking process, the first yarn 7 and the second yarn 8 are provided first. In this case, the two yarns 7, 8 are usually provided without tension or with equal tensions. Thereupon, the yarns 7, 8 are plied together, resulting in a twine without excess length Δ. In a further process step, the twine without excess length Δ is exposed to a predetermined temperature in an autoclave after an appropriate preparation, e.g., knitting, so that the first yarn 7 and the second yarn 8 shrink. In this embodiment, the yarns 7, 8, in particular their materials, were chosen such that they shrink to different degrees under the predetermined conditions, resulting in the twine 6 of excess length Δ.

In the manufacturing method using different tensions, the first yarn 7 and the second yarn 8 are plied together with different tensions, and the twine 6, i.e., its yarns 7, 8, is relaxed after plying. The choice of the tensions for achieving a desired amount of excess length Δ of the first yarn 7 compared to the second yarn 8 can be determined by a person skilled in the art on the basis of the modulus of elasticity of the two yarns 7, 8. It is apparent that, for example, a twine in which PA 940 dtex is plied with aramid 1660 dtex always requires a different pretension for obtaining the twine 6 of excess length Δ than a twine in which PA1400 dtex is plied with aramid 1660 dtex.

In order to empirically test whether the above-illustrated rope 1 with the twine 6 of excess length Δ processed therein has a higher cut resistance than a comparable rope without a twine 6 of excess length Δ, the measurement described below was performed. It goes without saying, however, that other measuring methods may also be used for determining the cut resistance.

Figure 4:
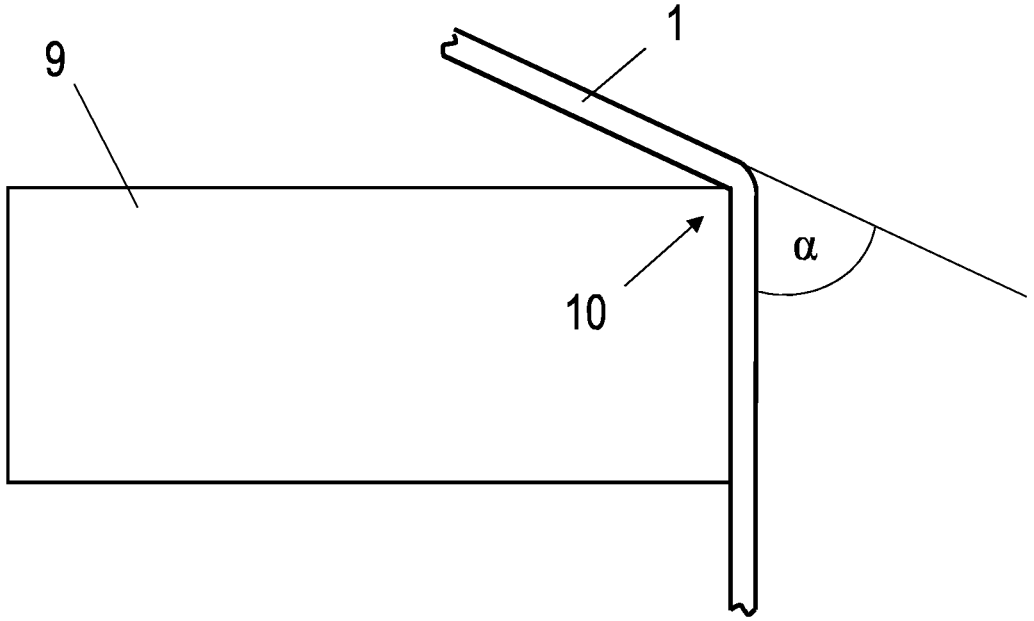
FIG. 4 shows a test setup for determining the cut resistance.

Initially, a height-adjustable test carrier was provided on which a granite block 9 having a length of 80 cm and comprising a naturally broken edge 10 (a pavement edge made of granite) was attached. Starting from a fixed anchor point located thereabove, a test mass (a steel cylinder of 80 kg) was lowered over the edge 10 with the rope to be tested. Due to the position of the anchor point, a deflection of the rope occurs at the edge 10 at a deflection angle α, as can be seen in FIG. 4. The edge 10 is located at a distance of 4 m from the anchor point (the stand). Immediately after the edge 10, the test mass is freely suspended. By installing a load cell, the forces occurring at the anchor point were recorded.

The test procedure is as follows:

A load cell is installed at the anchor point and the test rope is attached to it.

In each case, the mass is suspended from the test rope in a shock-free manner just below the stone edge and is then lowered by 2 m.

The rope is moved horizontally by means of pulleys attached to the side (This could correspond to a situation in which the lowered climber swings sideways to the next stand located underneath). The test rope is thus pulled along the sharp edge 10 in both directions until it breaks. The edge length that was swept over until the break occurred is measured and referred to as the breaking length.

In order to achieve a lateral movement as uniform as possible, the force of the lateral pull is introduced directly below the edge 10. Stop bolts at the respective end of the edge 10 prevent the rope from moving beyond the edge 10. At the end of the tests, the sharpness of the edge 10 is verified by a rope model that has already been tested. In this case, the edge 10 remained unchanged.

The first test rope was a state-of-the-art rope, designed according to EN892 with a diameter of 9.8 mm. This was a core-sheath rope with a polyamide sheath. The deflection angle was 45°. A breaking length of approx. 200 cm was achieved.

The second test rope was a rope according to the invention with aramid in the intermediate sheath in the construction according to the invention, designed according to EN892 with a diameter of 9.8 mm. A breaking length of approx. 340 cm was achieved. In this way, the breaking length was increased by 70% in comparison to the state-of-the-art rope.

The invention claimed is:

1. A rope made of textile fiber material, comprising:
- a rope core;
- a sheath surrounding the rope core; and
- an intermediate sheath or a reinforcement located between the sheath and the rope core,
- wherein the rope comprises a twine of excess length, the twine of excess length being formed so that it comprises at least a first yarn and a second yarn which are twisted together, the first yarn having a greater length than the second yarn, measured in an untwisted state of a unit length of the twine of excess length,
- wherein the twine of excess length is present in the intermediate sheath or the reinforcement,
- wherein the diameter of the rope is at least 5 mm.

2. A rope according to claim 1, wherein the first yarn comprises high-strength fibers.

3. A rope according to claim 1, wherein the first yarn comprises p-aramid fibers, m-aramid fibers, LCP fibers, UHMWPE fibers or PBO fibers.

4. A rope according to claim 1, wherein the second yarn comprises non-high-strength fibers.

5. A rope according to claim 1, wherein the second yarn comprises PA fibers, PES fibers or PP fibers.

6. A rope according to claim 1, wherein the first yarn is at least 5% longer than the second yarn, measured in the untwisted state of the unit length of the twine.

7. A rope according to claim 1, wherein the first yarn is at least 12% longer than the second yarn, measured in the untwisted state of the unit length of the twine.

8. A rope according to claim 1, wherein the weight proportion of the first yarn in the twine of excess length is 30% to 90%.

9. A rope according to claim 1, wherein the weight proportion of the twine of excess length in the intermediate sheath and/or in the reinforcement, in each case, accounts for 50% to 100% of the intermediate sheath or the reinforcement.

10. A rope according to claim 1, wherein the rope core is constructed from one or several twisted or braided cores.

11. A rope according to claim 1, wherein the rope core comprises non-high-strength fibers.

12. A rope according to claim 1, wherein the rope core comprises PA fibers, PES fibers or PP fibers.

13. A rope according to claim 11, wherein the rope is configured as a climbing rope according to the EN892 standard.

14. A rope according to claim 1, wherein the rope core comprises high-strength fibers.

15. A rope according to claim 1, wherein the rope core comprises aramid fibers, UHMWPE fibers or PBO fibers.

16. A rope according to claim 1, wherein the diameter of the rope is in a range of 5 mm to 60 mm.

17. A method of using a rope according to claim 11, comprising a user placing and using the rope as a climbing rope.

18. A method of manufacturing a rope according to claim 1, comprising the steps of:
- a) manufacturing a twine of excess length by:
  - providing the first yarn and the second yarn;
  - twisting the first yarn with the second yarn;
  - wherein the first yarn and the second yarn are twisted together with essentially the same tension and the same length and the twine is subjected to a shrinking process after twisting;
- b) manufacturing the rope by:
  - introducing the rope core into a braiding machine and forming the sheath around the rope core, wherein the intermediate sheath or the reinforcement located between the sheath and the rope core comprises the twine of excess length.

19. A method according to claim 18, wherein the shrinking process is performed in an autoclave.

20. A rope made of textile fiber material, comprising:
- a rope core;
- a sheath surrounding the rope core; and
- an intermediate sheath or a reinforcement located between the sheath and the rope core,
- wherein the rope comprises a twine of excess length, the twine of excess length being formed so that it comprises at least a first yarn and a second yarn which are twisted together, the first yarn having a greater length than the second yarn, measured in an untwisted state of a unit length of the twine of excess length,
- wherein the twine of excess length is present in the intermediate sheath or the reinforcement,
- wherein the first yarn is at least 5% longer than the second yarn, measured in the untwisted state of the unit length of the twine.

* * * * *